US011365036B2

(12) United States Patent
Maguire

(10) Patent No.: US 11,365,036 B2
(45) Date of Patent: Jun. 21, 2022

(54) VALVE ARRANGEMENT FOR PRESSURISED TANK IN A CLOSURE DEVICE

(71) Applicant: Gizmo Packaging Limited, Glasgow (GB)

(72) Inventor: Jordan Maguire, Glasgow (GB)

(73) Assignee: Gizmo Packaging Limited, Glasgow (GB)

( * ) Notice: Subject to any disclaimer, the term of this patent is extended or adjusted under 35 U.S.C. 154(b) by 320 days.

(21) Appl. No.: 16/343,943

(22) PCT Filed: Nov. 2, 2017

(86) PCT No.: PCT/GB2017/053311
§ 371 (c)(1),
(2) Date: Apr. 22, 2019

(87) PCT Pub. No.: WO2018/087520
PCT Pub. Date: May 17, 2018

(65) Prior Publication Data

US 2019/0389637 A1 Dec. 26, 2019

(30) Foreign Application Priority Data

Nov. 14, 2016 (GB) ..... 1619265
Mar. 23, 2017 (GB) ..... 1704624

(51) Int. Cl.
*B65D 51/28* (2006.01)

(52) U.S. Cl.
CPC ..... *B65D 51/2892* (2013.01); *B65D 51/2842* (2013.01); *B65D 51/2864* (2013.01)

(58) Field of Classification Search
CPC ..... B65D 51/2892; B65D 51/2864; B65D 51/2842; B65D 51/2857; B65D 51/2828;
(Continued)

(56) References Cited

U.S. PATENT DOCUMENTS 6,843,368 B1 1/2005 Frutin
2002/0053524 A1 * 5/2002 Alticosalian ..... B65D 51/2864 206/219
(Continued)

FOREIGN PATENT DOCUMENTS

EP 2292525 A1 3/2011
JP S5018846 Y1 * 6/1975 ..... B65D 51/2892
(Continued)

OTHER PUBLICATIONS

International Preliminary Report on Patentability dated May 14, 2019 for PCT/GB2017/053311, 12 pages.
(Continued)

*Primary Examiner* — Anthony D Stashick
*Assistant Examiner* — L Kmet
(74) *Attorney, Agent, or Firm* — Faegre Drinker Biddle & Reath LLP

(57) ABSTRACT

A closure assembly for a container comprising a pressurised tank and a plug member, the pressurised tank has an interior volume and a cylindrical wall including an annular boss member at its open end. The plug member has an annular channel arranged at a first side of the plug member adapted to sealingly engage with the boss member. The channel has at least one orifice extending from the floor or outer side wall of the channel to a nozzle at the second side of the plug member. The orifice is sealed from the interior volume of the tank when the channel is sealingly engaged with the boss member in a first position, but is in fluid communication with the interior volume of the tank when at least part of the channel is no longer engaged with the boss member in a second position.

16 Claims, 7 Drawing Sheets

(58) Field of Classification Search
CPC ..... B65D 51/28; B65D 83/425; B65D 41/34; B65D 85/73; B65D 47/242; Y10S 215/08
See application file for complete search history.

(56) References Cited

U.S. PATENT DOCUMENTS

| | | | |
|---|---|---|---|
| 2004/0208960 | A1 | 10/2004 | Marshall |
| 2015/0266634 | A1 | 9/2015 | Yang |

FOREIGN PATENT DOCUMENTS

| | | | |
|---|---|---|---|
| JP | S5018846 | Y1 | 6/1975 |
| JP | 2009132404 | A | 6/2009 |
| WO | WO0183313 | A2 | 11/2001 |
| WO | 2012141804 | A2 | 10/2012 |

OTHER PUBLICATIONS

International Search Report and Written Opinion, dated Feb. 21, 2018, 17 pages.

* cited by examiner

VALVE ARRANGEMENT FOR PRESSURISED TANK IN A CLOSURE DEVICE

FIELD OF THE INVENTION

The present invention relates to a closure assembly, for use with a container such as a beverage container, which can fire an additive liquid from a pressurised tank of the closure assembly into a liquid in the container by operation of the closure assembly. The invention also relates to a valve arrangement in such a closure assembly and to a method of introducing an additive liquid into a container by means of operating such a closure assembly.

BACKGROUND

In a number of applications, such as mixtures of different liquids, it may be necessary to release and mix an additive liquid into another liquid shortly before the liquid mixture is used. It may not be possible or desirable to store the liquids in a premixed form, as they may react undesirably with each other when stored as the mixture for a period of time. An example of this may be two component pharmaceuticals which have a longer shelf life when unmixed than they do when mixed. However, it can also apply to other liquids or to mixtures of liquids and gases, such as water, alcoholic beverages, other beverages, and other solvents or solutions. The term "beverage" when used in this specification includes any liquid, whether or not provided for drinking purposes, which may be mixed with an additive liquid, and is not limited to potable beverages.

A closure device for use with a beverage container which can release an additive liquid into the beverage by operation of the closure device is known from the prior art. International Patent Application WO2007/129116 discloses a closure device comprising a cap member defining a fluid chamber and a plug member which sealingly engages an aperture in the bottom of the fluid chamber. The cap member is raised relative to the plug member by unscrewing the cap member, from a closed position in which the plug member closes the bottom aperture to an open position in which the plug member is partially withdrawn from the bottom aperture to allow pressurised fluid to flow from the fluid chamber through a nozzle passage in the plug member to the beverage in the beverage container.

The known device has the disadvantage that it has a single nozzle passage and requires a relatively complex arrangement of seals.

It is an object of the present invention to overcome one or more disadvantages of the prior art.

SUMMARY OF THE INVENTION

According to a first aspect of the present invention there is provided a closure assembly for a container comprising a pressurised tank and a plug member, wherein the pressurised tank has an interior volume and a cylindrical wall with an open end, the cylindrical wall including an annular boss member at the open end, wherein the plug member has an annular channel arranged at a first side of the plug member adapted to sealingly engage with the annular boss member of the cylindrical wall of the pressurised tank, the channel having inner and outer concentric side walls and a channel floor, wherein the annular channel has at least one orifice extending from one of the channel floor and outer side wall to a second side of the plug member opposite the first side, wherein the orifice is arranged to be sealed from the interior volume of the tank when the annular channel is sealingly engaged with the annular boss member in a first closed position of the closure assembly and which is arranged to be in fluid communication with the interior volume of the tank when at least part of the annular channel is no longer engaged with the annular boss member in a second firing position of the closure assembly, and wherein the orifice comprises a nozzle at the second side of the plug member for ejection of pressurised liquid from the pressurised tank.

The open end of the cylindrical tank wall and the annular channel effectively form a plug and socket, which serve to seal the one or more orifices when the closure assembly is in the closed position, but open all the one or more orifices simultaneously when the tank is raised or rotated relative to the plug member and the closure assembly is in the firing position.

In this specification the term "boss member" is used to refer to a substantially cylindrical member adapted to fit around and engage with a substantially cylindrical plug member, typically forming a circular tube. The wall thickness of the boss member may be the same as or different to the wall thickness of the remainder of the cylindrical wall of the pressurised tank.

In one embodiment the annular channel may have a single orifice comprising a single nozzle, so that pressurised liquid may be ejected in a single high speed jet.

In another embodiment the annular channel may have a plurality of orifices which are arranged to be sealed from the interior volume of the tank when the annular channel is sealingly engaged with the open end of the cylindrical wall in the first closed position of the closure assembly and which are in fluid communication with the interior volume of the tank when the annular channel is separated from the open end of the cylindrical wall in the second firing position of the closure assembly. Preferably the orifices are arranged in an annular pattern.

If the closure assembly has a plurality of orifices, a pressurised additive liquid can be ejected in a "shower head" pattern, to improve distribution and mixing of the additive liquid within the beverage or other liquid in the container.

In one embodiment the lower end of the annular boss member may be uniform about its circumference, and the annular boss member may be adjacent to the channel floor in the first closed position and may be raised from the channel floor in the second firing position of the closure assembly, thereby opening the one or more orifices in the channel. In this embodiment the tank is raised relative to the plug member to fire pressurised liquid from the tank.

In another embodiment the lower end of the annular boss member may have an aperture in the wall of the annular boss member, and the annular boss member may be rotated from the first closed position in which the aperture is not adjacent to the at least one orifice to the second firing position in which the aperture is adjacent to the at least one orifice, such that a fluid path is provided from the pressurised tank through the aperture and at least one orifice. In this embodiment the tank is rotated or twisted relative to the plug member to fire pressurised liquid from the tank.

Preferably the closure assembly further comprises a closure attached to the pressurised tank. The assembly is supplied as a pre-assembled closure component which can be added to the container at the place where the container is filled.

Preferably the plug member includes a stopper portion adapted to project inside the open end of the cylindrical wall of the pressurised tank in the first closed position. Such a stopper portion comprises a secure and positive seal to the pressurised tank.

The plug member may include a first seal, which may be in the annular channel, adapted to seal between the plug member and an internal surface of the cylindrical wall in the first closed position. Such a seal ensures that the tank cannot leak during storage of the closure assembly in its pressurised state, either before or after fitting to a container.

The plug member may include a second seal, which may be in the annular channel, adapted to seal between the plug member and an external surface of the cylindrical wall in the second firing position. Such a seal ensures when the additive is fired under pressure from the tank it cannot pass upwards outside the tank between the neck of the container and the tank.

The plug member may be attached to a casing which includes a sleeve portion which at least partially surrounds the pressurised tank. The casing can be secured to the neck of the container so that the plug member is fixed relative to the container. The tank can then be moved relative to the container to achieve movement of the closure assembly from the closed position to the firing position.

The casing may include a cylindrical inner wall adapted to fit inside a neck of a container and a cylindrical outer wall connected to the inner wall by a bridge portion, the outer wall having an internal thread on its inner surface adapted to engage with an external thread on a neck of a container.

In one aspect of the invention the closure assembly further comprises a closure attached to the pressurised tank, wherein the closure has an outer wall adapted to fit around the outer wall of the casing and having a detent member for engaging a corresponding detent member on the outer wall of the casing, the detent members being adapted to hold the closure assembly in the first closed position.

The detent member on the outer wall of the closure may be provided on a frangible portion of the closure, such that removal of the frangible portion of the closure permits movement of the closure assembly from the first closed position to the second firing position.

If the detent members are all that prevent relative vertical movement of the closure and the casing, then removal of the frangible portion allows the closure and tank to move upwards relative to the plug member and casing under the internal pressure of the contents of the tank, so that the closure assembly can move from the first closed position to the second firing position.

In another aspect of the invention the closure assembly further comprises a closure attached to the pressurised tank, wherein the closure has an outer wall adapted to fit around the outer wall of the casing and having an internal thread adapted to engage a corresponding external thread on the outer wall of the casing.

The internal thread on the outer wall of the closure and the external thread on the outer wall of the casing may be adapted to permit movement of the closure assembly from the first closed position to the second firing position by rotation of the closure relative to the casing, which in turn causes the tank to be raised relative to the plug member.

If the closure member is unscrewed from the casing, the threads cause the closure and tank to move upwards relative to the plug member and casing, so that the closure assembly can move from the first closed position to the second firing position.

In another aspect of the invention the casing includes a cylindrical inner wall adapted to fit inside a neck of a container and a cylindrical outer wall and a flange extending radially outward from the cylindrical outer wall and adapted to fit over the he top edge of the neck of the container.

Such a closure assembly can be used with a glass bottle having a relatively narrow neck, and is not limited to threaded necks.

Preferably the sleeve portion is below the cylindrical inner wall.

The cylindrical inner wall may have a first circumferential rib on its inner surface adapted to engage with a first detent portion provided on an external surface of the cylindrical wall of the pressurised tank when the closure assembly is in the second firing position to prevent the tank separating from the casing.

The first rib and first detent portion prevent the tank from separating from the casing after firing of the closure assembly.

The cylindrical inner wall may have a second circumferential rib on its inner surface adapted to engage with a second frangible detent portion provided on an external surface of the cylindrical wall of the pressurised tank to hold the tank relative to the casing in a third closed position of the closure assembly prior to movement of the tank relative to the casing to the first closed position of the closure assembly, wherein the plurality of orifices of the annular channel are sealed from the interior volume of the tank in the third closed position.

The second rib and second detent portion allow the closure assembly to be pre-assembled, filled and pressurised, and transported to the place of filling of the containers, where the closure assembly may be secured to the container. The second detent portion ensures that the plug member continues to seal the tank closed, even though the internal pressure of the tank may urge the tank to be raised relative to the plug member from the first fully closed position.

The cylindrical inner wall may have a third circumferential rib on its inner surface below the second circumferential rib adapted to engage with the second frangible detent portion when the tank is moved relative to the casing from the third closed position of the closure assembly to the first closed position of the closure assembly, to detach the second frangible detent portion from the tank.

The third rib serves to detach the second frangible detent portion from the tank when the tank is pushed downwards relative to the casing and plug member from the third closed position of the closure assembly to the first closed position of the closure assembly, during the filling and closing of the container at the filling location.

Preferably a closure is attached to the pressurised tank.

Preferably the closure is a screw cap or crown cap adapted to engage with a thread or formation on a neck of a container.

Preferably the sleeve portion forms a sliding fit on the pressurised tank. The sleeve portion serves to provide lateral support to the tank, meaning that the tank wall can be relatively thin, thereby saving material and cost.

According to a second aspect of the present invention there is provided a method of introducing an additive liquid into a container including the steps of:

providing a closure assembly at a neck of the container, the closure assembly comprising a pressurised tank and a plug member, wherein the pressurised tank has an interior volume and a cylindrical wall with an open end, the cylindrical wall including an annular boss member at the open end, the plug member having an annular channel arranged at a first side of the plug member, the pressurised tank containing an additive liquid and a pressurised propellant, the annular channel having inner and outer concentric side walls and a channel floor, wherein the annular channel has at least one orifice extending from one of the channel floor and outer side wall to a second side of the plug member opposite the first side, moving the pressurised tank relative to the plug member from a first closed position in which the annular channel of the plug member is sealingly engaged with the annular boss member to seal the one or more orifices, to a second firing position in which at least part of the annular channel is no longer engaged with the annular boss member to provide fluid communication from the interior of the pressurised tank to the one or more orifices, and firing the additive liquid from the interior of the pressurised tank through the one or more orifices to an interior volume of the container under action of the pressurised propellant.

In one embodiment the lower end of the annular boss member is uniform about its circumference, and in the step of moving the pressurised tank relative to the plug member the pressurised tank is raised relative to the plug member such that the annular boss member is raised from the channel floor in the second firing position of the closure assembly.

In another embodiment the lower end of the annular boss member has an aperture in the wall of the annular boss member, and in the step of moving the pressurised tank relative to the plug member the annular boss member is rotated from the first closed position in which the aperture is not adjacent to the at least one orifice to the second firing position in which the aperture is adjacent to the at least one orifice, such that a fluid path is provided from the pressurised tank through the aperture and at least one orifice.

The method may include the further step of removing the closure assembly from the container.

Preferably the container contains a beverage or other liquid and the step of firing the additive liquid includes ejecting the additive liquid from the one or more orifices at a speed sufficient to at least partially mix the additive liquid with the beverage or other liquid.

BRIEF DESCRIPTION OF THE DRAWINGS

The invention will be described, by way of example only, with reference to the drawings in which.

DESCRIPTION OF SPECIFIC EMBODIMENTS

Figure 1:
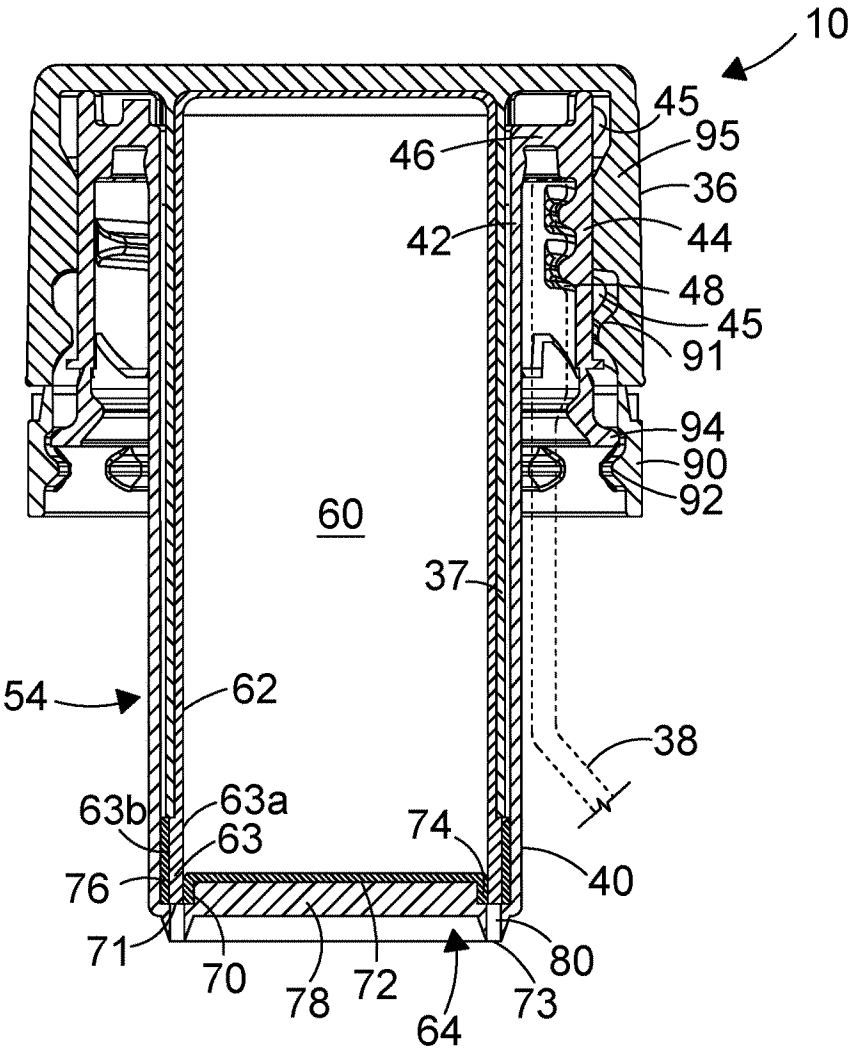
FIG. 1 shows a schematic cross-sectional view of a closure assembly according to an embodiment of the present invention in a first closed position.

With reference to FIG. 1 there is shown a closure assembly 10 in a first closed position. The closure assembly 10 is adapted to be fitted to the neck 38 of a container that contains a fluid (not shown), for example, a PET bottle. The neck 38 is shown in dotted outline on one side only, for clarity. The container may hold a variety of liquids such as water, or a pharmaceutical or glucose solution. The liquid may be for consumption, but may instead be a chemical composition for other use, such as cleaning, healthcare, hair dye application, painting or household maintenance. However, for the purposes of this description, the liquid held in the container will hereinafter be referred to as the beverage.

The closure assembly 10 includes a closure or cap member 36. A fluid chamber or tank 60 is connected to the closure 36. In the example the closure 36 includes a cylindrical wall 37 which surrounds the tank 60, which may be formed separately. The closure 36 is bonded or moulded to the tank 60.

A separate casing 54 sits inside the neck 38 of the bottle. The casing includes a sleeve portion 40 which surrounds the tank and has a plug member 64 at its lower end. At its upper end the casing 54 includes an inner cylindrical wall 42 and an outer cylindrical wall 44. A bridge portion 46 or flange connects the inner and outer cylindrical walls 42, 44. The outer wall 44 includes an internal thread 48 which engages with the standard thread (not shown) on the bottle neck 38, and is used to secure the casing 54 to the bottle neck 38.

The fluid chamber 60 contains an additive liquid and a pressured propellant fluid. The fluid held in the fluid chamber 60 may be of significantly greater pressure than the beverage held in the container. The fluid chamber 60 is enclosed by a fluid chamber wall 62. The fluid chamber 60 may be formed using plastic injection moulding and may be formed of PET or any other suitable plastic. In the example of FIG. 1 the fluid chamber 60 is formed as a separate blow moulded chamber and secured to the closure 36 by moulding the closure 36 around it. However the fluid chamber 60 may be simply bonded to the closure by adhesive or formed by any other means.

The casing 54 and the plug member 64 may be formed by injection moulding or another suitable method.

Figure 2:
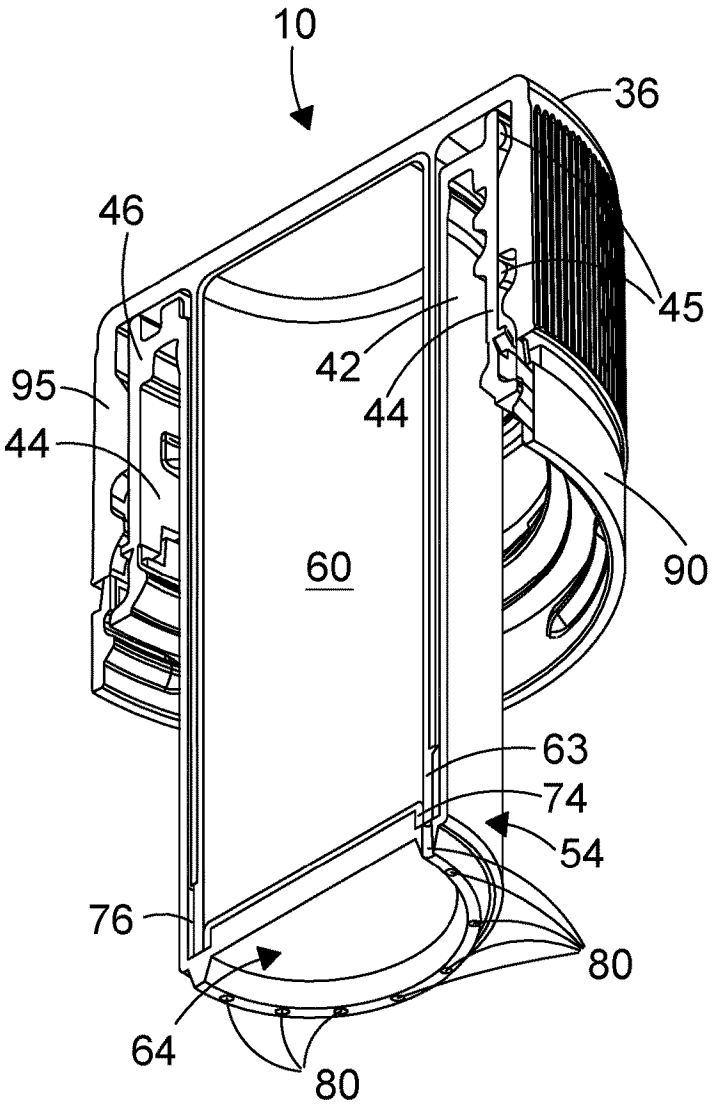
FIG. 2 shows an isometric sectional view of the closure assembly of FIG. 1.

In the closed position of FIGS. 1 and 2 the fluid chamber 60 is sealed closed by a valve arrangement comprising an annular boss member 63 and the plug member 64. The annular boss member 63 is formed from an open end of the fluid chamber wall 62 of the tank 60. In the example the annular boss member 63 has a wall thickness greater than the remainder of the fluid chamber wall 62. The plug member 64 has an annular channel 70 arranged in the first upper side 72 of the plug member 64. The channel 70 has inner and outer concentric side walls and a channel floor 71.

The channel 70 has a first seal 74 provided on the inner concentric side wall of the channel 70 which seals between the plug member 64 and an internal surface 63*a* of the annular boss member 63 in the closed position of FIGS. 1 and 2. The internal surface 63*a* of the annular boss member 63 is an internal surface of the fluid chamber wall 62 of the tank 60.

The channel 70 also has a second seal 76 provided on the outer concentric side wall of the channel 70 which seals between the plug member 64 and an external surface 63*b* of the annular boss member 63 in the closed position of FIGS. 1 and 2. The external surface 63*b* of the annular boss member 63 is an external surface of the fluid chamber wall 62 of the tank 60.

Figure 8:
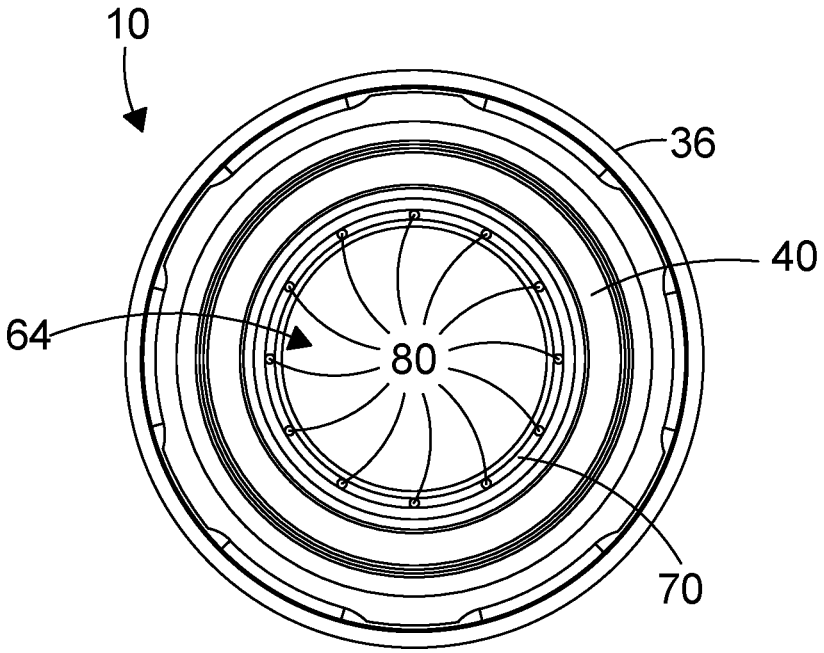
FIGS. 8 and 9 show views from below of the closure assemblies of FIGS. 1 and 5, with a plurality of orifices and a single orifice respectively.
Figure 9:
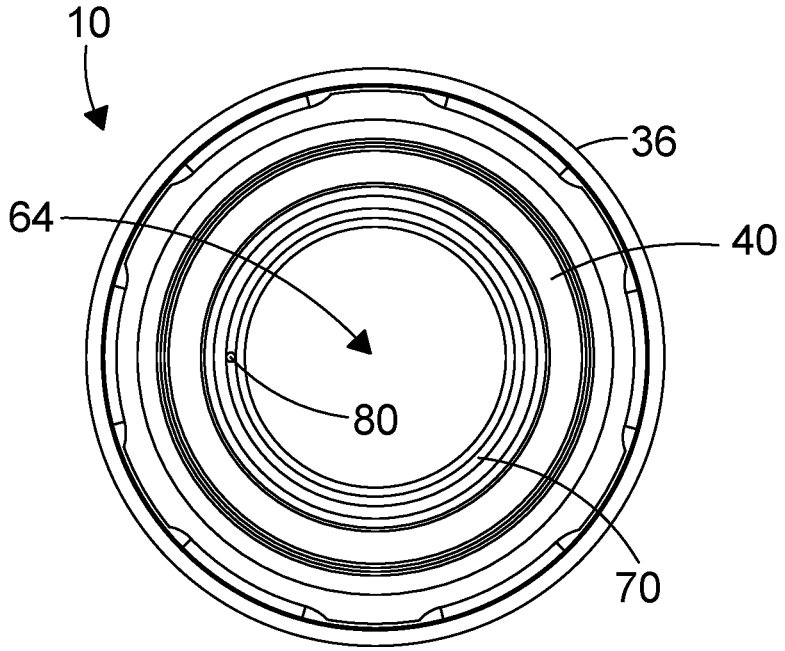

The annular channel 70 has one or more orifices 80 extending from the channel floor 71 through the plug member 64 to a second lower side 73 of the plug member opposite the first upper side 72. In the illustrated example the annular channel 70 has a plurality of orifices 80 extending from the channel floor 71, typically between 10 and 20 orifices. FIG. 8 shows a view from below of a closure assembly where the annular channel 70 has 12 orifices 80 in an annular arrangement at a regular spacing. However the annular channel 70 may instead have a single orifice 80, or any other number of orifices 80. FIG. 9 shows an alternative arrangement where the annular channel 70 has a single orifice 80 forming a single nozzle. The single orifice may typically have a diameter of between 0.5 mm and 2.0 mm.

In the illustrated example the orifices 80 extend vertically, i.e. parallel to the longitudinal axis of rotation of the closure assembly 10, from the channel floor 71 through the plug member 64 to a second lower side 73 of the plug member opposite the first upper side 72. However the one or more orifices may instead be angled, as shown in the embodiment illustrated in FIG. 10. Alternatively the one or more orifices may extend horizontally, i.e. perpendicular to the longitudinal axis of rotation of the closure assembly 10, through the outer side wall of the channel, which in this embodiment is a continuation of the sleeve portion 40 of the casing 54, as shown in the embodiment illustrated in FIG. 11.

The plug member includes a stopper portion 78 which in the closed position projects inside the boss member 63, and acts with the first and second seals 74, 76 to form a secure and positive seal, capable of maintaining the pressure within the pressurised tank 60. The seals 74, 76 ensure that when the closure assembly 10 is in the closed position shown in FIGS. 1 and 2 the orifices 80 are sealed closed and are not in communication with the interior volume of the tank 60.

In the embodiment of FIGS. 1 to 4 the seals 74, 76 are formed as a resilient coating. Alternatively the seals 74, 76 may be formed monolithically from a resilient material with the stopper portion 78, which is attached, for example by a detent boss 79, to the plug member 64 at the lower end of the casing 54, as shown in the embodiment illustrated in FIG. 12.

Figure 13:
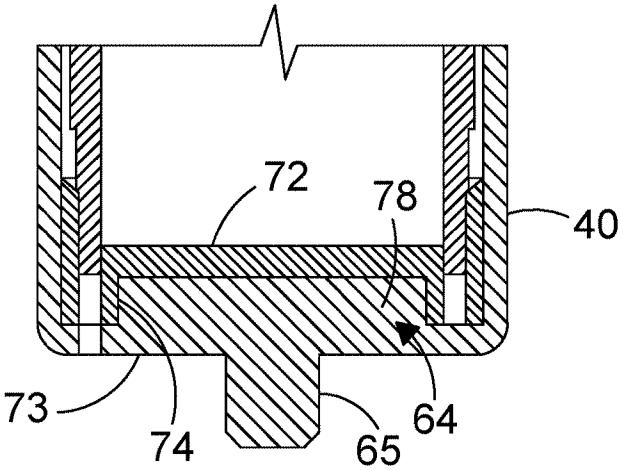

The plug member 54 may be provided with an attachment member 65 on its lower surface 73 for the attachment of a brush applicator (not shown) or the like, as shown in the embodiment illustrated in FIG. 13.

The closure 36 optionally includes a detachable or frangible portion 90, referred to as a tamper-evident band, of the type which is known in the art. The frangible portion 90 prevents the closure 36 from being unscrewed from the casing 54 until the frangible portion 90 has been removed. The frangible portion 90 includes an internal circumferential rib 92 on its inner surface, which engages with a detent portion 94 in the form a flange provided on the outer wall 44 of the casing 54. In order to release the contents from the pressurised tank 60, the closure 36 and tank 60 must be raised relative to the casing 54 and plug member 64. The outer wall 44 of the casing 54 may be provided with external threads 45 which engage with internal threads 91 provided on the outer wall 95 of the closure 36. The frangible portion 90 is removed by tearing in a conventional manner, and the closure 36 can be raised relative to the casing 54 by unscrewing.

In an alternative embodiment the external threads on the outer wall 44 of the casing 54 and the internal threads 91 on the outer wall 95 of the closure 36 can be omitted so that the closure 36 and tank 60 lift relative to the casing 54 and plug member 64 by action of the internal pressure in the tank 60 once the band 90 has been removed.

Figure 4:
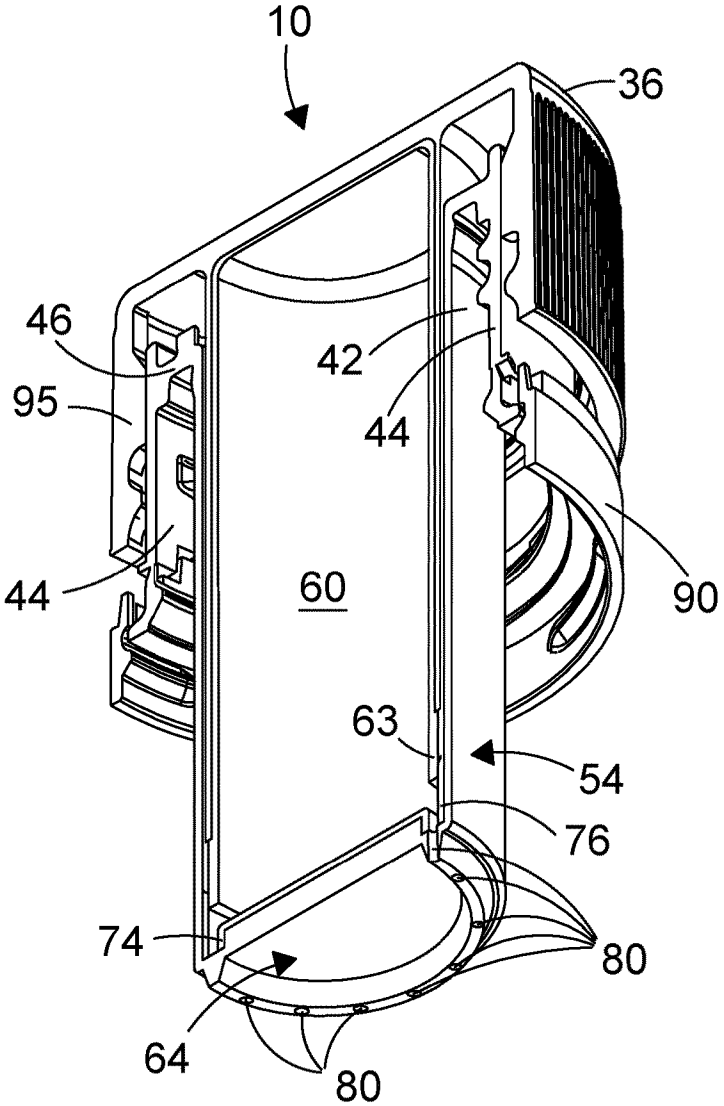
FIG. 4 shows an isometric sectional view of the closure assembly of FIG. 3.
Figure 3:
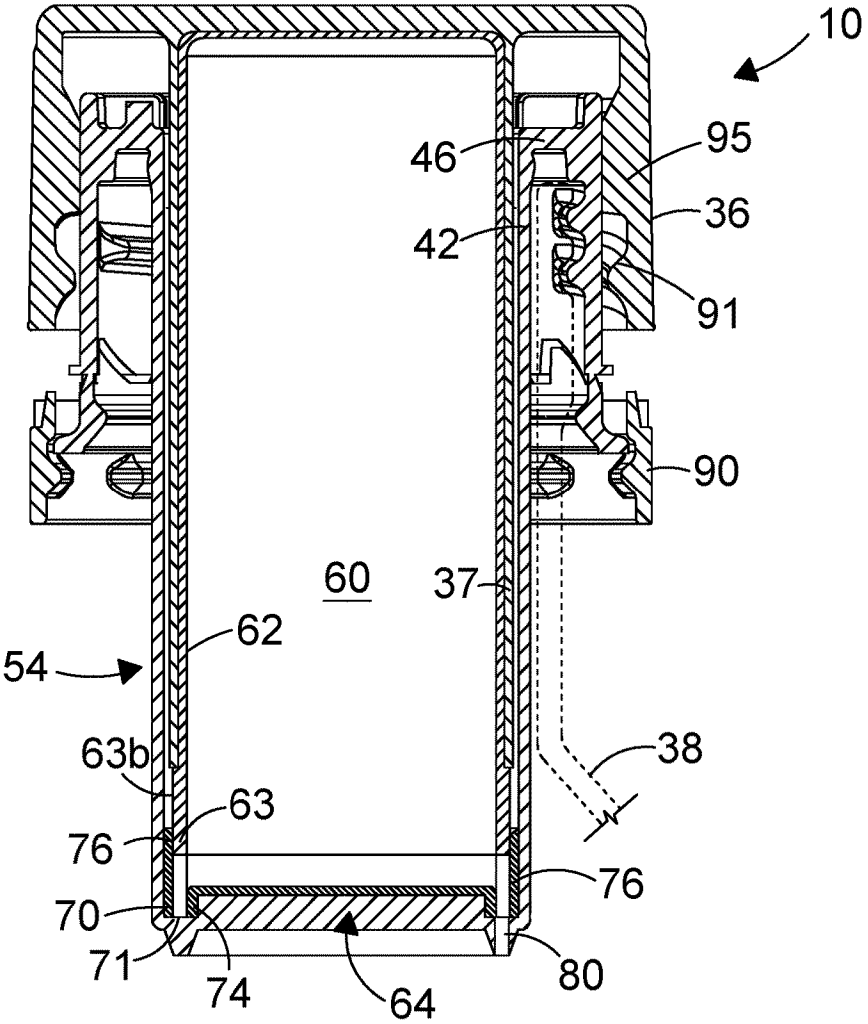
FIG. 3 shows a schematic cross-sectional view of the closure assembly of FIG. 1 in a second open or firing position.

FIGS. 3 and 4 show the closure assembly 10 in the open or firing position. The frangible portion 90 has been separated from the closure 36, and the closure 36 and tank 60 have been raised relative to the casing 54 and plug member 64, so that the plug member 64 is no longer fully engaged with the open end 63 of the tank 60. The stopper portion 78 is below the annular boss member 63, which no longer is engaged in the annular channel 70. The orifices 80 are now in communication with the interior volume of the tank 60, so that the liquid additive is fired through the orifices in a "shower head" pattern under the action of the pressurised propellant in the tank 60. The "shower head" pattern encourages mixing and distribution of the liquid additive in the beverage (not illustrated) in the container to which the closure assembly 10 is attached.

A further detent or stop mechanism (not shown) may be provided to prevent further rotation of the closure 36 relative to the casing 54, so that further rotation of the closure 36 causes both the closure and casing 54 to be lifted on the threads of the neck 38 so that the closure assembly 10 can be removed from the neck 38 of the bottle.

Figure 6:
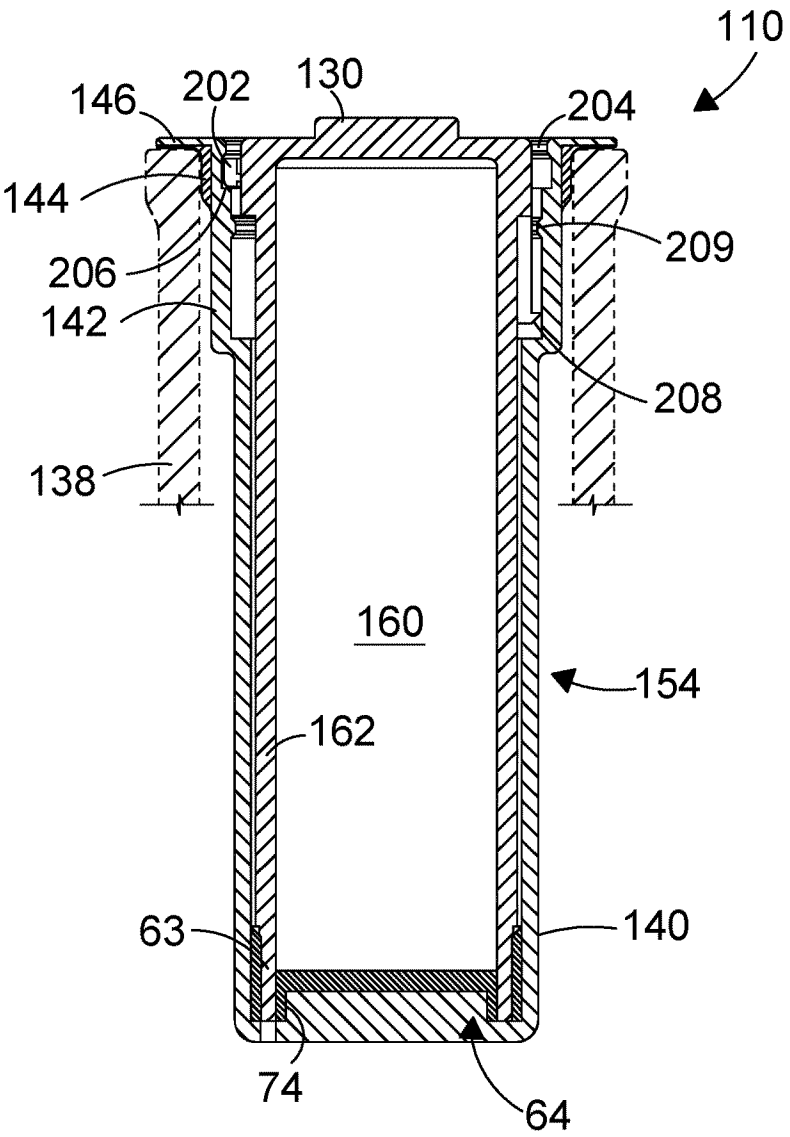
FIGS. 5, 6 and 7 show schematic cross-sectional views of a closure assembly according to another embodiment of the present invention in a third transport or closed position, a first assembled or closed position and second open or firing position respectively.
Figure 5:
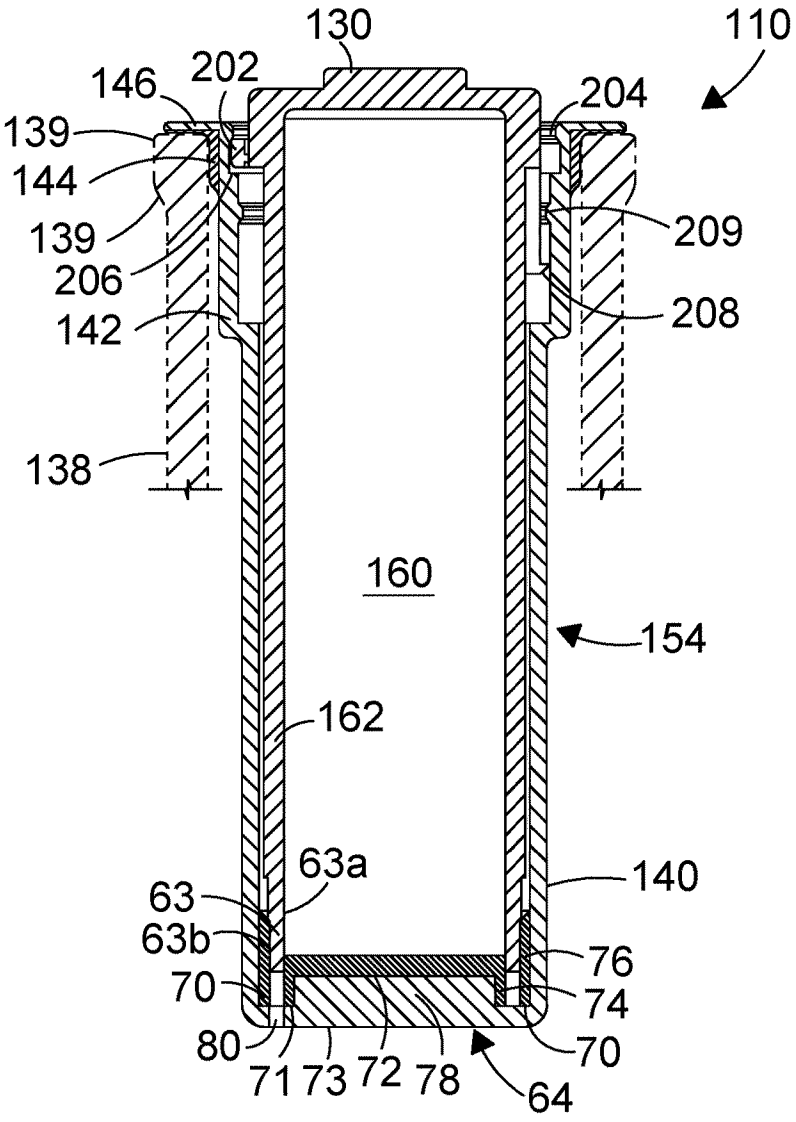
Figure 7:
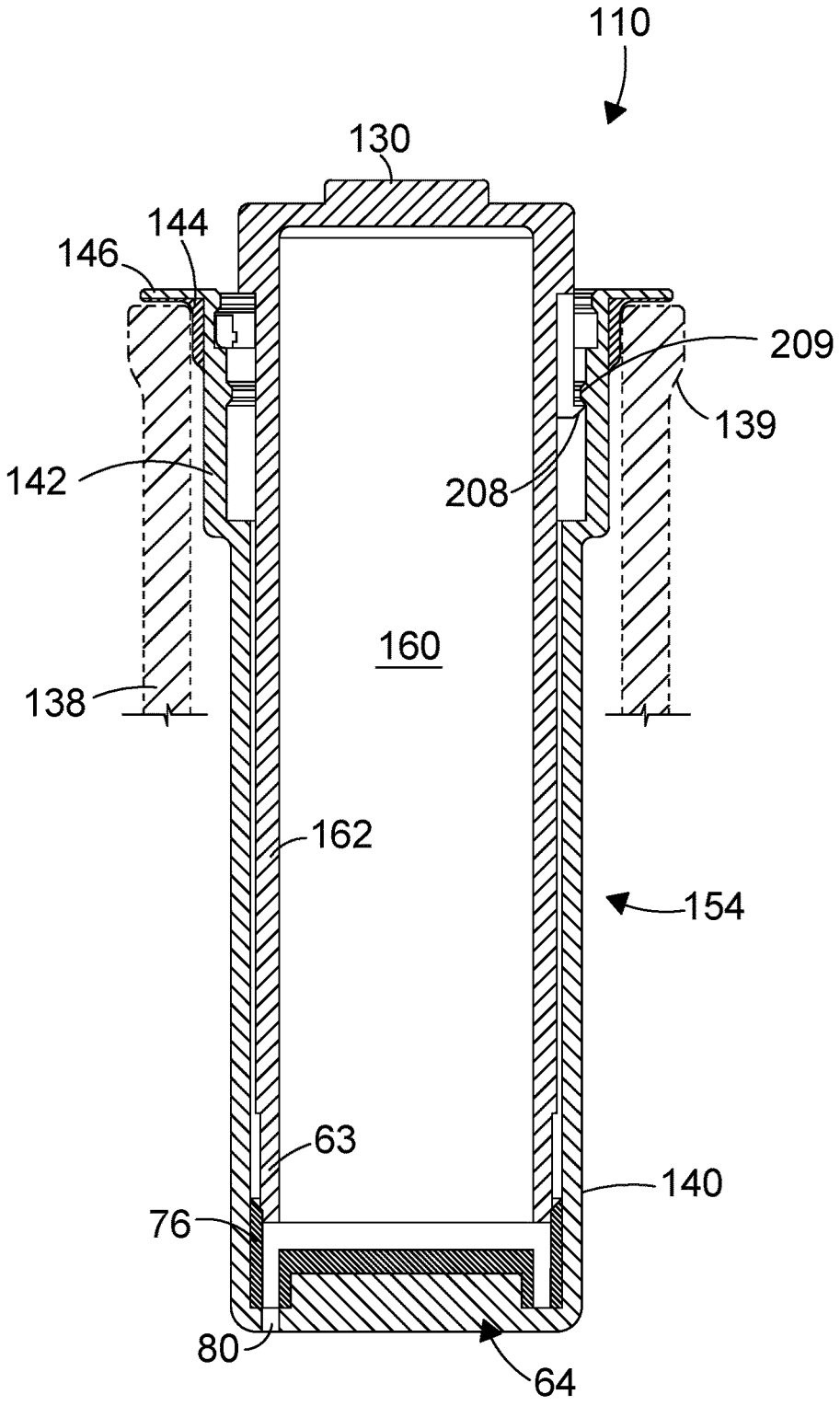

Referring to FIGS. 5, 6 and 7, a further embodiment of the invention is disclosed. The closure assembly 110 is adapted to be fitted inside the neck 138 of a bottle that contains a fluid (not shown), for example, a glass bottle which is conventionally closed by a crown cap or screw top. The container may hold a variety of liquids as described with reference to FIGS. 1 and 2.

The closure assembly 110 is adapted to be secured to the underside of a cap or closure (not shown) which is bonded to the upper surface 130 of the fluid chamber or tank 160, for example by adhesive or moulding. The cap can be a crown cap or screw top or any other suitable cap.

A separate casing 154 sits inside the neck 138 of the bottle. The casing includes a sleeve portion 140 which surrounds the tank and has a plug member 64 at its lower end. The plug portion 64 is similar to that described in the embodiment of FIGS. 1 and 2, and is not described further. At its upper end the casing 154 includes an inner cylindrical wall 142 and a bridge portion or flange 146 adapted to sit on the top of the neck 138. A seal 144 is provided around the inner wall 142, to seal between the casing 154 and the neck 138 of the bottle, and to secure the casing 154 to the bottle neck 138.

The fluid chamber 160 contains an additive liquid and a pressured propellant fluid. The fluid held in the fluid chamber 160 may be of significantly greater pressure than the beverage held in the container. The fluid chamber 160 is enclosed by a fluid chamber wall 162. The fluid chamber 160 may be formed using plastic injection moulding and may be formed of PET or any other suitable plastic.

The casing 154 and the plug member 64 may be formed by injection moulding or another suitable method.

In the closed position of FIG. 6 the fluid chamber 160 is sealed closed by the valve arrangement comprising an annular boss member 63 and the plug member 64. The annular boss member 63 is formed from an open end of the cylindrical fluid chamber wall 162. In the example the annular boss member 63 has a wall thickness less than the remainder of the fluid chamber wall 162. The plug member 64 has an annular channel 70, a first seal 74 provided on the inner concentric side wall of the channel 70 which seals between the plug member 64 and an internal surface 63*a* of the annular boss member 63 in the closed positions of FIGS. 1 and 2, a second seal 76 provided on the outer concentric side wall of the channel 70 which seals between the plug member 64 and an external surface 63*b* of the annular boss member 63 in the closed positions of FIGS. 1 and 2, and a plurality of orifices 80 extending from the channel floor 71 through the plug member 64 to the lower side 73 of the plug member opposite the first upper side 72.

Figure 10:
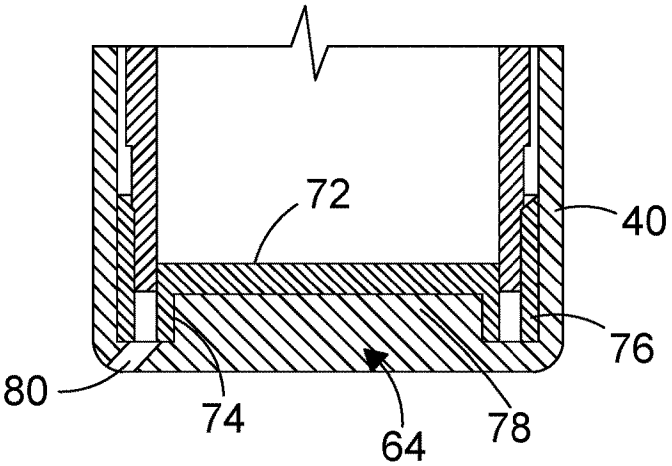
Figure 11:
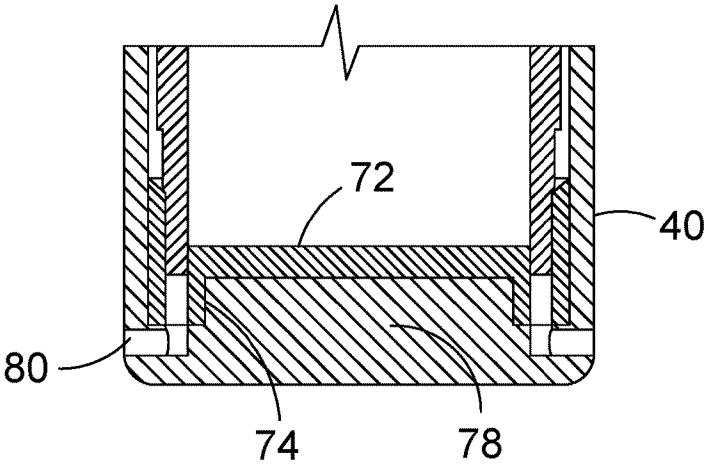

In this embodiment too there may be a plurality of orifices 80, as shown in FIG. 8, or a single orifice 80, as shown in FIG. 9, and the orifice or orifices 80 may extend at an angle, as shown in FIG. 10, or horizontally, as shown in FIG. 11.

Figure 12:
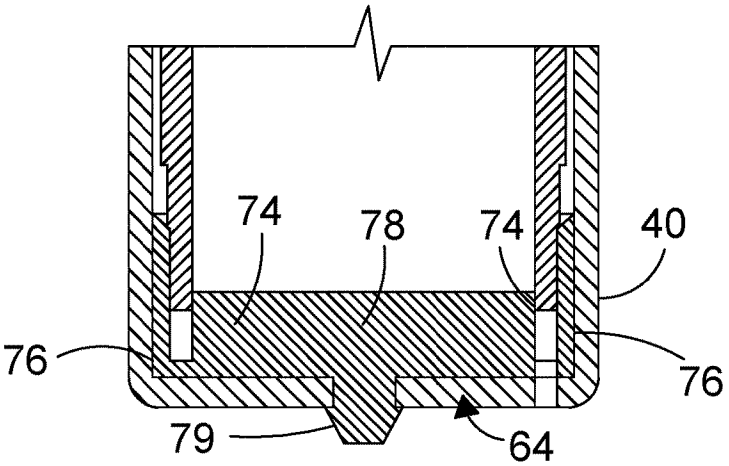
FIGS. 10, 11, 12 and 13 show partial schematic cross-sectional views of the closure assemblies of FIGS. 1 and 5 showing the plug member and orifice.

The plug member includes a stopper portion 78 which in the closed position projects inside the boss member 63, and acts with the first and second seals 74, 76 to form a secure and positive seal, capable of maintaining the pressure within the pressurised tank 160. In this embodiment too the seals may be monolithic with the stopper portion 78, as shown in FIG. 12, and the plug member may include an attachment member 65, as shown in FIG. 13.

The fluid chamber wall 162 includes an upper portion 200 to which is attached a frangible detent portion in the form of a detachable rib 202. One or more such ribs 202 can be provided, and they may extend partially or completely around the tank 160. The cylindrical wall 142 of the casing 154 includes an inwardly projecting circumferential rib 204 which engages the detachable rib 202 on the tank 160 to prevent the tank separating from the casing 154 and plug member 64 when the closure assembly 110 has been assembled and the tank 160 contains the additive and pressurised propellant, but before the closure assembly 110 is secured to the neck 138 of the bottle by a cap member. This position, referred to as the third closed position, is illustrated in FIG. 5. The closure assembly 110 has been placed in the neck 138, but the cap (not shown) has not yet been secured to the neck, so the tank 160 is still free to project above the neck 138.

When the cap is secured to the neck, the cap and tank 160 are displaced downwards to the first closed position shown in FIG. 6. The detachable rib 202 is urged against a circumferential rib or abutment 206 on the inner surface of the cylindrical wall 142. The force required to secure the cap to the neck 138 is sufficient to cause the circumferential rib 206 to detach the detachable rib 202 from the tank 160. In the illustrated example a crown cap can be fixed to the neck 138 by deforming the crown cap in a known manner around the external rib 139 on the neck 138 of the bottle.

When the cap is removed from the neck 138 of the bottle, the tank 160 is free to rise relative to the casing 154 and plug member 64 to the open or firing position illustrated in FIG. 7. Because the detachable rib 202 has been detached from the tank 160, the tank 160 can rise above the position shown in FIG. 5 to the position shown in FIG. 7, where the orifices 80 are open and in communication with the interior volume of the tank 160. A detent portion 208 provided on the external surface of the cylindrical fluid chamber wall 162 of the tank 160 engages with a first circumferential rib 209 provided on the inner surface of the cylindrical wall 142 to prevent the tank 160 separating completely from the casing 154. In this position the liquid additive is fired through the orifices in a "shower head" pattern under the action of the pressurised propellant in the tank 160, as in the first embodiment of FIGS. 1 to 4. In the open position of FIG. 7 the outer seal 676 continues to seal between the boss 63 and the casing 154, so that additive cannot escape between the tank 160 and casing 54.

After firing, the closure assembly 110 can be removed from the neck 138 of the bottle with the cap (not shown).

Figure 16:
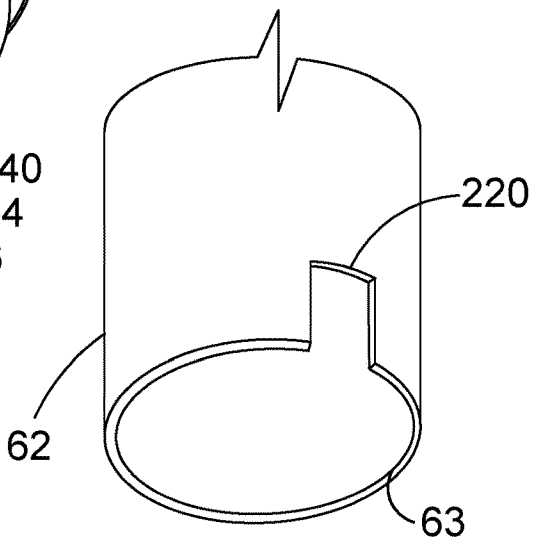
FIG. 16 is a partial view of the annular boss member of the closure assembly of FIGS. 14 and 15.
Figure 15:
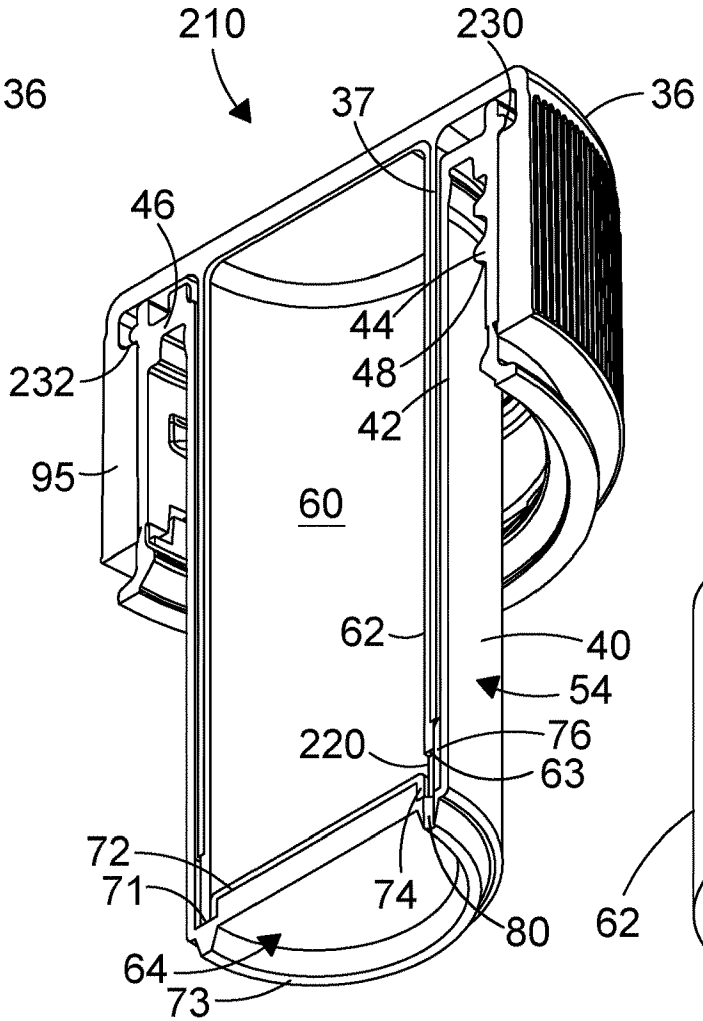
FIGS. 14 and 15 show isometric sectional views of a closure assembly according to another embodiment of the present invention in a first assembled or closed position and a second open or firing position respectively.
Figure 14:
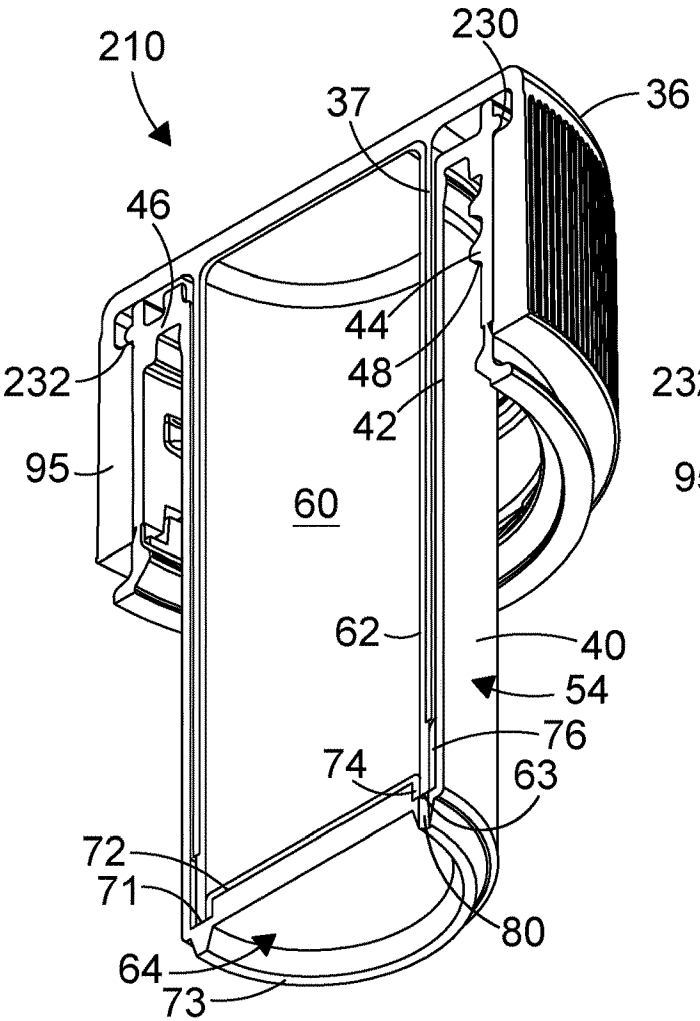

Referring to FIGS. 14, 15 and 16, a further embodiment of a closure assembly 210 according to the invention is disclosed. The embodiment is similar to the embodiment of FIGS. 1 to 4, and similar components have the same reference numeral and are not further described. The closure assembly 210 is adapted to be fitted to the neck of a container (not shown) and can be used for the same purposes as the closure assembly of FIGS. 1 to 4.

The closure assembly 210 includes a closure or cap member 36. A fluid chamber or tank 60 is connected to the closure 36. In the example the closure 36 includes a cylindrical wall 37 which surrounds the tank 60, which may be formed separately. The closure 36 is bonded or moulded to the tank 60.

A separate casing 54 sits inside the neck of the bottle. The casing 54 includes a sleeve portion 40 which surrounds the tank and has a plug member 64 at its lower end. The plug member 64 is similar to the plug member described with reference to FIGS. 1 and 4, although in this embodiment there is a single orifice 80 extending from the channel floor 71 through the plug member 64 to a second lower side 73 of the plug member opposite the first upper side 72 where it forms a nozzle.

At its upper end the casing 54 includes an inner cylindrical wall 42 and an outer cylindrical wall 44. A bridge portion 46 or flange connects the inner and outer cylindrical walls 42, 44. The outer wall 44 includes an internal thread 48 which engages with the standard thread (not shown) on the bottle neck (not shown), and is used to secure the casing 54 to the bottle neck (not shown).

In the closed position of FIG. 14 the fluid chamber 60 is sealed closed by a valve arrangement comprising an annular boss member 63 and the plug member 64. The annular boss member 63 in this embodiment has an aperture 220 in the form of a cut out portion at the lower end of the fluid chamber wall 62, shown in detail in FIG. 16. In the closed position of FIG. 14 the aperture 220 is not adjacent to the orifice 80.

The single orifice may typically have a diameter of between 0.5 mm and 2.0 mm. In the illustrated example the orifice 80 extends vertically, i.e. parallel to the longitudinal axis of rotation of the closure assembly 210, from the channel floor 71 through the plug member 64 to the second lower side 73 of the plug member opposite the first upper side 72. However the orifice may instead be angled, as shown in the embodiment illustrated in FIG. 10. Alternatively the orifice may extend horizontally, i.e. perpendicular to the longitudinal axis of rotation of the closure assembly 210, through the outer side wall of the channel, which in this embodiment is a continuation of the sleeve portion 40 of the casing 54, as shown in the embodiment illustrated in FIG. 11.

The seals 74, 76 ensure that when the closure assembly 210 is in the closed position shown in FIG. 14 the orifice 80 is sealed closed and is not in communication with the interior volume of the tank 60.

The closure 36 is arranged to be rotatable about the casing 54. An external rib 230 on the casing engages with an internal projection 232 on the outer wall 95 of the closure 36, to allow relative rotation of the closure 36 and casing 54, but to prevent the closure 36 being lifted relative to the casing 54. A detent means (not shown) is provided to prevent to provide an end stop for rotation of the closure 36 relative to the casing 54.

The closure 36 optionally includes a detachable or frangible portion (not shown), referred to as a tamper-evident band, of the type which is known in the art. The frangible portion prevents the closure 36 from being rotated relative to the casing 54 until the frangible portion has been removed. The frangible portion may be similar to the frangible portion 90 illustrated in FIGS. 1 to 4.

FIG. 15 shows the closure assembly 210 in the open or firing position. The tamper-proof band has been removed, allowing the closure 36 and tank 60 to be rotated, typically in a counter-clockwise direction similar to the direction in which a cap is unscrewed, relative to the casing 54 and plug member 64, until a detent means or other suitable end stop prevents further relative rotation. In this position, illustrated in FIG. 15, the aperture 220 in the annular boss member 63 is aligned with the orifice 80, which is therefore in communication with the interior volume of the tank 60, so that the liquid additive is fired through the orifice under the action of the pressurised propellant in the tank 60. In this position part of the annular channel 70 in the region of the aperture 220 is no longer engaged with the annular boss member 63. The single nozzle of the orifice 80 produces a high pressure jet of additive, encouraging mixing and distribution of the liquid additive in the beverage (not illustrated) in the container to which the closure assembly 210 is attached.

The number of orifices 80 can be increased, for example to 2 or 3, provided that the aperture 220 is of such a size that the tank 60 can be rotated relative to the plug member 64 from a closed position in which the aperture 220 is not aligned with any of the orifices 80, to an open or firing position in which the aperture 220 is aligned with all of the orifices 80. In such an arrangement the additive will be ejected from the nozzles of the orifices 80 sequentially as they are uncovered.

Further rotation of the closure 36, after the detent means or other suitable end stop has prevented further relative rotation of the closure 36 and casing 54, causes both the closure 36 and casing 54 to be lifted on the threads of the neck 38 of the container (shown in FIG. 3) so that the closure assembly 210 can be removed from the neck 38 of the bottle.

The invention is not limited to the shapes and dimensions shown in the illustrated embodiments. The valve assembly of the present invention can be used with any pressurised tank in a closure assembly. Other forms of detent can be used to control the limits of relative movement of the tank 60, 160 and casing 54, 154 of the present invention.

The illustrated seals 74, 76 may be formed as overmoulded components of a soft plastic, or may be formed as separate O-ring seals, optionally retained in circumferential grooves in the plug member 64 and/or boss 63.

The invention offers the advantage of a simple tank shape, which is easy to mould and does not require a narrow neck.

When used with a plurality of orifices, the invention offers the advantage of a "shower head" type arrangement of orifices, which serve as nozzles to spray the liquid additive over a wider area on the surface of the liquid in the bottle, leading to improved mixing compared to the prior art valve arrangements which offer only a single nozzle. When a single orifice is used, providing a single nozzle, the nozzle can be directed at an angle horizontally to direct the additive away from the surface of the main liquid, by simple orientation of the orifice passage. The provision of an annular channel 70 which engages with an annular boss member 63 ensures that the orifices are securely sealed in the closed position, and that the orifices can be readily opened by simple twisting or lifting of the annular boss member 63 relative to the annular channel 70.

The invention claimed is:

1. A closure assembly for a container comprising a fluid chamber, a plug member, and a closure attached to the fluid chamber, wherein the fluid chamber has an interior volume and a cylindrical wall with an open end, the cylindrical wall including an annular boss member at the open end, wherein the plug member has an annular channel arranged at a first side of the plug member adapted to sealingly engage with the annular boss member of the cylindrical wall of the fluid chamber, the channel having inner and outer concentric side walls and a channel floor, wherein the annular channel has at least one orifice extending from one of the channel floor and outer side wall to a second side of the plug member opposite the first side, wherein the orifice is arranged to be sealed from the interior volume of the fluid chamber when the annular channel is sealingly engaged with the annular boss member in a first closed position of the closure assembly and which is arranged to be in fluid communication with the interior volume of the fluid chamber when at least part of the annular channel is no longer engaged with the annular boss member in a second firing position of the closure assembly, wherein the orifice comprises a nozzle at the second side of the plug member for ejection of pressurised liquid from the fluid chamber, wherein the plug member includes a stopper portion adapted to project inside the open end of the cylindrical wall of the fluid chamber in the first closed position and a first seal provided in the annular channel and adapted to seal between the stopper portion and an internal surface of the annular boss member in the first closed position, wherein the plug member includes a second seal provided in the annular channel and adapted to seal between the plug member and an external surface of the annular boss member in the second firing position, and wherein the plug member is attached to a casing which includes a sleeve portion which at least partially surrounds the fluid chamber.

2. The closure assembly according to claim 1, wherein the lower end of the annular boss member has a uniform thickness about its circumference, and wherein the annular boss member is raised from the channel floor in the second firing position of the closure assembly.

3. The closure assembly according to claim 1, wherein the lower end of the annular boss member has an aperture in the wall of the annular boss member, and wherein the annular boss member is rotated from the first closed position in which the aperture is not adjacent to the at least one orifice to the second firing position in which the aperture is adjacent to the at least one orifice, such that a fluid path is provided from the fluid chamber through the aperture and at least one orifice.

4. The closure assembly according to claim 1, wherein the casing includes a cylindrical inner casing wall adapted to fit inside a neck of a container and a cylindrical outer casing wall connected to the cylindrical inner casing wall by a bridge portion, the cylindrical outer casing wall having an internal thread on its inner surface adapted to engage with an external thread on a neck of a container.

5. The closure assembly according to claim 1, wherein the closure has an outer wall adapted to fit around the outer wall of the casing and having a detent member for engaging a corresponding detent member on the outer wall of the casing, the detent members being adapted to hold the closure assembly in the first closed position.

6. The closure assembly according to claim 1, wherein the closure has an outer wall adapted to fit around the outer wall of the casing and having an internal thread adapted to engage a corresponding external thread on the outer wall of the casing.

7. The closure assembly according to claim 6, wherein the internal thread on the outer wall of the closure and the external thread on the outer wall of the casing are adapted to permit movement of the closure assembly from the first closed position to the second firing position by rotation of the closure relative to the casing.

8. The closure assembly according to claim 1, wherein the casing includes a cylindrical inner wall adapted to fit inside a neck of a container and a cylindrical outer wall and a flange extending radially outward from the cylindrical outer wall and adapted to fit over the top edge of the neck of the container.

9. The closure assembly according to claim 8, wherein the cylindrical inner wall has a first circumferential rib on its inner surface adapted to engage with a first detent portion provided on an external surface of the cylindrical wall of the fluid chamber when the closure assembly is in the second firing position to prevent the fluid chamber separating from the casing.

10. The closure assembly according to claim 9, wherein the cylindrical inner wall has a second circumferential rib on its inner surface adapted to engage with a second frangible detent portion provided on an external surface of the cylindrical wall of the fluid chamber to hold the fluid chamber relative to the casing in a third transport position of the closure assembly prior to movement of the fluid chamber relative to the casing to the first closed position of the closure assembly, wherein the plurality of orifices of the annular channel are sealed from the interior volume of the fluid chamber in the third transport position.

11. The closure assembly according to claim 10, wherein the cylindrical inner wall has a third circumferential rib on its inner surface below the second circumferential rib adapted to engage with the second frangible detent portion when the fluid chamber is moved relative to the casing from the third transport position of the closure assembly to the first closed position of the closure assembly, to detach the second frangible detent portion from the fluid chamber.

12. The closure assembly according to claim 8, wherein the closure is a screw cap or crown cap adapted to engage with a thread or formation on a neck of a container.

13. The closure assembly according to claim 1, wherein the annular channel has a plurality of orifices extending from one of the channel floor and outer side wall to a second side of the plug member opposite the first side, wherein the orifices are arranged in an annular pattern, wherein each of the plurality of orifices is arranged to be sealed from the interior volume of the fluid chamber when the annular channel is sealingly engaged with the annular boss member in a first closed position of the closure assembly, wherein each of the plurality of orifices is arranged to be in fluid communication with the interior volume of the fluid chamber when the annular channel is separated from the annular boss member in a second firing position of the closure assembly, and wherein each orifice comprises a nozzle at the second side of the plug member for ejection of pressurised liquid from the fluid chamber.

14. A method of introducing an additive liquid into a container including the steps of:

providing a closure assembly according to claim 2 at the neck of a container, the fluid chamber containing an additive liquid and a pressurised propellant, raising the fluid chamber relative to the plug member from a first closed position in which the annular channel of the plug member is sealingly engaged with the annular boss member of the cylindrical wall of the fluid chamber to seal the at least one orifice, to a second firing position in which the annular channel of the plug member is separated from the annular boss member of the cylindrical wall of the fluid chamber to provide fluid communication from the interior of the fluid chamber through the open end of the fluid chamber to the at least one orifice, thereby firing the additive liquid from the interior of the fluid chamber through the at least one orifice and out of the corresponding nozzle to the interior volume of the container under action of the pressurised propellant.

15. A method of introducing an additive liquid into a container including the steps of:

providing a closure assembly according to claim 3 at the neck of a container, the fluid chamber containing an additive liquid and a pressurised propellant, rotating the fluid chamber relative to the plug member from a first closed position in which the annular channel of the plug member is sealingly engaged with the annular boss member of the cylindrical wall of the fluid chamber to seal the at least one orifice, to a second firing position in which the aperture in the wall of the annular boss member is adjacent to the at least one orifice to provide fluid communication from the interior of the fluid chamber through the aperture in the wall of the annular boss member to the at least one orifice, thereby firing the additive liquid from the interior of the fluid chamber through the at least one orifice and out of the corresponding nozzle to the interior volume of the container under action of the pressurised propellant.

16. The method of claim 14, wherein the method includes the further step of removing the closure assembly from the container.

* * * * *